United States Patent [19]

Wong

[11] 4,333,575

[45] Jun. 8, 1982

[54] COLLAPSIBLE HANGER DEVICE

[76] Inventor: Joseph Wong, 855 Grenon Ave., Unit #2, Ottawa, Ontario, Canada, K2B 6G1

[21] Appl. No.: 188,565

[22] Filed: Sep. 18, 1980

[51] Int. Cl.[3] ..... A47F 5/00

[52] U.S. Cl. ..... 211/118; 211/87; 211/100; 248/293

[58] Field of Search ..... 211/113, 118, 86, 87, 211/99, 100, 104, 101, 96, 170, 171; 248/300, 214, 215, 219.2, 284, 293; 224/42.45 R, 42.45 A, 42.46 R, 42.46 A

[56] References Cited

U.S. PATENT DOCUMENTS

| | | | |
|---|---|---|---|
| 927,369 | 7/1909 | May | 211/96 X |
| 2,142,830 | 1/1939 | Wendell | 211/100 |
| 4,171,748 | 10/1979 | Fabien | 211/100 |

FOREIGN PATENT DOCUMENTS

| | | | |
|---|---|---|---|
| 146834 | 9/1954 | Sweden | 211/104 |
| 887851 | 1/1962 | United Kingdom | 211/105.1 |

*Primary Examiner*—Roy D. Frazier
*Assistant Examiner*—Robert W. Gibson, Jr.
*Attorney, Agent, or Firm*—Birch, Stewart, Kolasch & Birch

[57] ABSTRACT

A collapsible hanger device comprises an elongate member having a pair of mutually angularly disposed walls extending longitudinally thereof and a pair of arms pivotally mounted on respective ones of the walls. The arms are pivotal relative to the walls about respective mutually angled axes of pivotation between collapsed positions, in which the arms are nestled in an angular space defined by the walls, and extended positions, in which the arms project laterally of the elongate member. The device can be suspended from a wall or a door.

11 Claims, 5 Drawing Figures

COLLAPSIBLE HANGER DEVICE

FIELD OF THE INVENTION

The present invention relates to a collapsible hanger device for use, for example, as a support for clothes hangers.

DESCRIPTION OF PRIOR ART

Foldable supports or hanging racks for this purpose have previously been proposed.

For example, in Canadian Pat. No. 1,011,321, issued May 31, 1977, there is disclosed a foldable support adapted to be mounted on a door or wall and comprising an elongated vertical housing having a channel-shaped transverse cross-section, and an arm having one end pivotally mounted on the housing for movement between a raised position, in which the arm is received in the recess in the housing, and a lower position, in which the arm projects horizontally upwardly from the housing.

In U.S. Pat. No. 4,094,414, issued June 13, 1978 to Richard E. Thiot et al, there is disclosed a clothes hanging rack comprising a rod telescopically mounted in one of the pair of bores in a container, and a clothes hanging bar pivotally mounted to the rod and arranged to be supported in a horizontal position when in its working position.

In U.S. Pat. No. 4,171,748, issued Oct. 23, 1979 to Samuel F. Fabien, there is disclosed a portable hanging assembly including an elongated housing pivotally connected to a hanger arm which is stored in the housing when not in use. The hanger arm can be dropped into a horizontal position for supporting clothes hangers, and a brace is hingedly positioned at one end on the hanger arm, the opposite end of the brace being slidably engaged with the housing.

The devices taught by these above-mentioned prior patents all have the disadvantage that they provide only one arm or the like which is pivotable into a horizontal, working position for supporting clothes hangers or other articles.

BRIEF SUMMARY OF INVENTION

It is an object of the present invention to provide a novel and improved hanger device which has a pair of arms which are pivotable in different planes.

More particularly, according to the present invention there is provided a collapsible hanger device comprising an elongate member having a pair of mutually angularly disposed walls extending longitudinally thereof; a pair of arms pivotally mounted on respective ones of the walls; the arms being pivotal relative to the walls about respective mutually angled axes of pivotation between collapsed positions, in which the arms are nestled in an angular space defined by the walls with the arms extending longitudinally of the elongate member, and extended positions, in which the arms project laterally of the elongate member; means for releasably supporting the arms in the extended positions; and means for suspending the elongated member from a support.

Preferably, the suspension means comprise a hook means extending from one of the walls for engagement over the top of a door, and means defining, for example, holes in the other of the walls for engagement with support screws. In this case, the collapsible hanger can either be mounted on a door, using the hook means, or on a wall, using the holes.

Whether or not such suspension means are provided, the present hanger device affords the advantage that one of the arms can extend horizontally and in a direction which is, for example, parallel to the door or wall on which the hanger device is mounted, whereas the other arm can extend in a different direction, for example perpendicular to the door or wall.

The hook means may be provided in the form of a strip-shaped member extending from and perpendicular to its wall, an opening being provided in the strip-shaped member for receiving a securement screw. This screw may be employed, for example, but mounting a camera or other article on the strip-shaped member, so that the hanger device can then be employed as a hand grip, with the arms in their collapsed positions.

DESCRIPTION OF DRAWINGS

The invention will be more readily understood from the following description of a preferred embodiment thereof given, by way of example, with reference to the accompanying drawings, in which.

DESCRIPTION OF PREFERRED EMBODIMENTS

Figure 1:
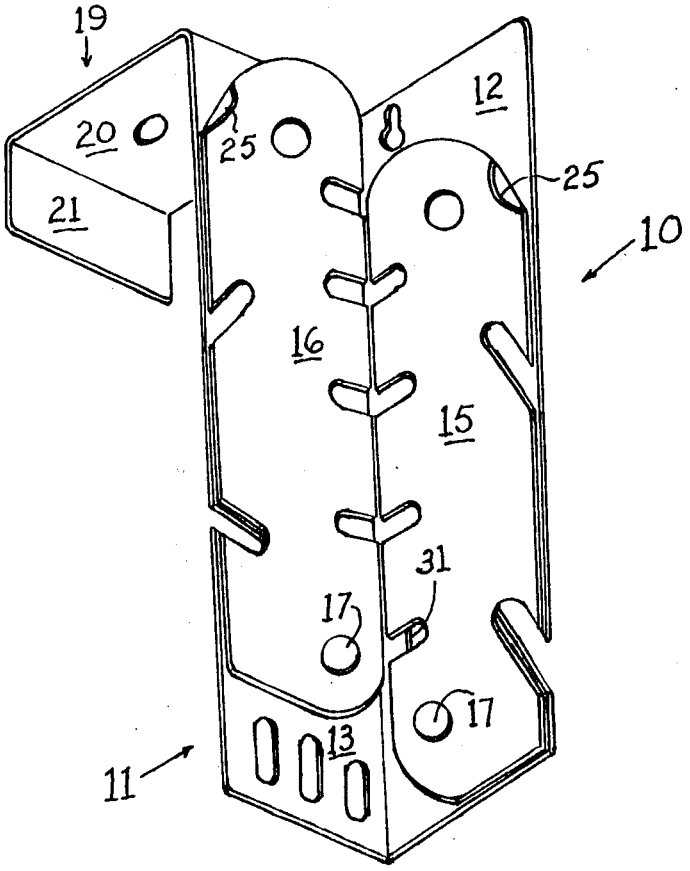
FIG. 1 shows a view taken in perspective of a collapsible hanger device according to a first embodiment of the invention in a collapsed condition.

Referring now to FIG. 1, there is shown a collapsible hanger device, indicated generally by reference numeral 10 which comprises an elongate member, indicated generally by reference numeral 11, made of aluminum alloy angle and having two walls or flanges 12 and 13, which extend at right angles to one another.

A pair of arms 15 and 16 are pivotally secured to the walls 12 and 13, respectively, by rivets 17.

One end of the elongate member 11 is provided with a hook-shaped member indicated generally by reference numeral 19.

The hook member 19 comprises a flat strip-shaped member 20 which forms an extension of the wall 13 and which extends, at right angles thereto, in a direction away from the wall 12. A further flat strip-shaped portion 21 extends from the free end of the strip-shaped member 20 and parallel to the wall 13.

Figure 2:
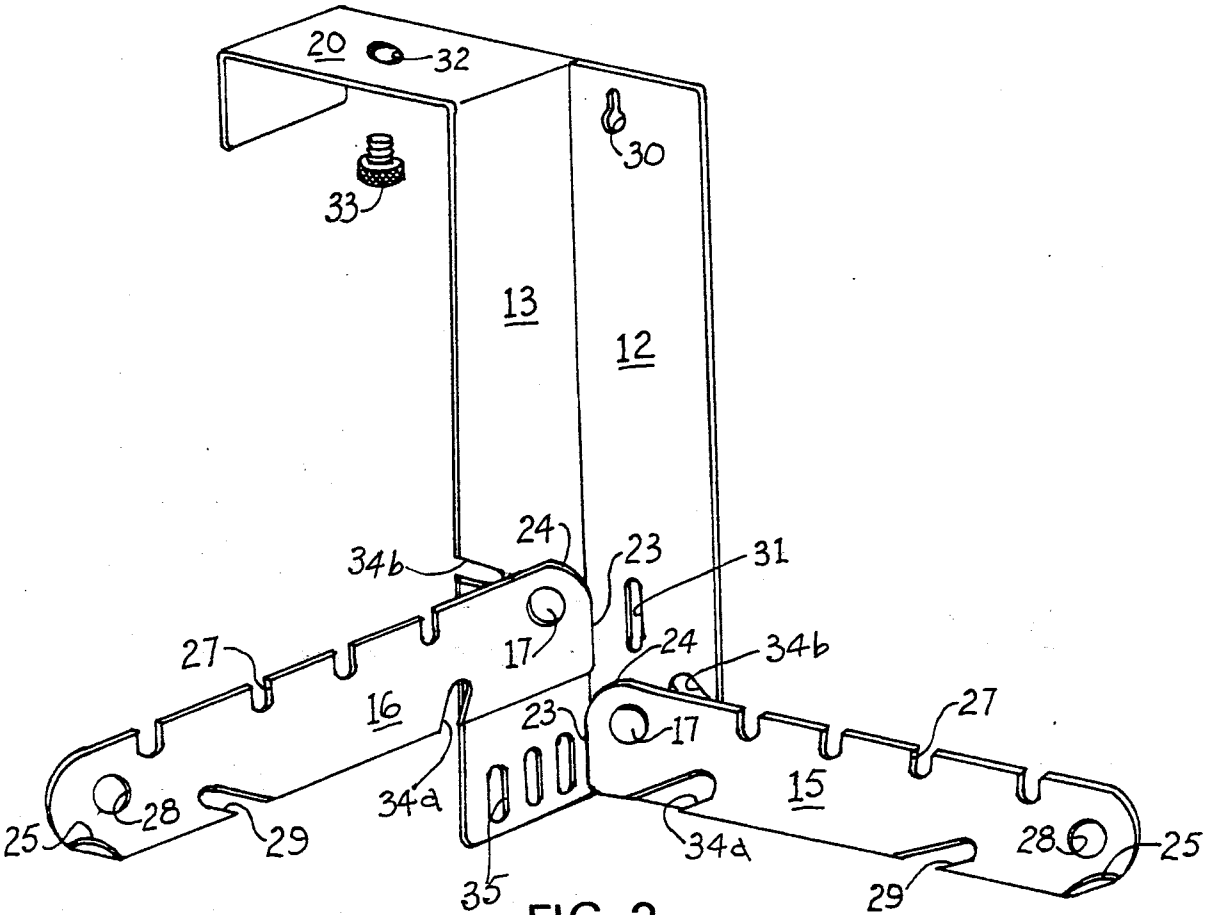
FIG. 2 shows a view in perspective of the device of FIG. 1 in an extended condition.

The arms 15 and 16 are pivotable, about the axes of their respective rivets 17, from collapsed positions, in which the arms 15 and 16 are illustrated in FIG. 1, into extended positions, in which the arms 15 and 16 are illustrated in FIG. 2. As can be seen from FIG. 2 the arms 15 and 16 are formed, at their innermost ends, with flat abutment surfaces 23 which, when the arms 15 and 16 are in their extended positions, abut the walls 12 and 13. However, to allow the pivotation of the arms 15 and 16 between their collapsed and extended positions, the arms 15 and 16 are also provided, at their innermost and upperpost portions, with rounded edges 24 to provide a clearance between the arms 15 and 16 and the walls 12 and 13 during such pivotation.

At their ends remote from the rivets 17, the arms 15 and 16 are each formed with a lug 25, which is bent so as to project from the plane of the respective arm 15 or 16. These lugs 25 serve as finger grips for manual engagement of the arms 15 and 16 when the latter are in their collapsed position, as shown in FIG. 1, and are required to be pivoted into their extended positions.

The arms 15 and 16, which are made of an aluminum alloy strip, are pivotable about the rivets 17 in respective planes which are at right angles to one another, the plane of pivotation of the arm 15 being adjacent and parallel to the plane of the wall 12 and the plane of pivotation of the arm 16 being adjacent and parallel to the plane of the wall 13.

The uppermost edges of the arms 15 and 16 are formed with U-shaped recesses or cutouts 27 for engagement, for example, with coat hangers.

Each of the arms 15 and 16 is also provided with a circular opening 28, near the end thereof which is remote from its rivet 17, and an elongate inclined recess or cutout 29 extending from the lowermost edge of the respective arm at an angle of approximately 35° to such lowermost edge. The openings 28 and the cutouts 29 may be used, for example, to secure the ends of cords or the like, for use as a drying line, to the arms 15 and 16, the opposite ends of the cords or the like being secured to any convenient anchorage to allow the cords or the like to be used for hanging clothes or other articles.

The wall 12 is also formed with a keyhole shaped opening 30 and an elongate opening 31 which can be engaged with screws (not shown) inserted into a wall or door surface for mounting the hanger device 10 on such surface.

The strip-shaped member 20 is formed with a circular opening 32 for receiving the threaded shank of a knurled bolt 33, which can be employed for securing an article, for example a camera, to the top of the strip-shaped member 20. In that case, the entire hanger device 10 can be employed, with the arms 15 and 16 in their collapsed positions, as a hand grip for supporting the camera or other article. In addition, the hook 19 can be fitted over the top of a door for mounting the entire hanger device 10 on the door.

Each of the arms 15 and 16 is also provided with a second inclined recess or cutout **34*a* extending at an angle of approximately 120° from the lowermost edge of the respective arm. A similar recess or cutout 34*b* is formed in the edge of each wall 12 and 13, the cutouts 34*b* being arranged to be aligned with the cutouts 34*a* when the arms 15 and 16 are in their collapsed positions, so that one of the cutouts 34*a* and the corresponding cutout 34*b* can be used as a bottle opener. For this purpose, the cutouts 34*a* and 34*b* are made larger than the cutouts 29**.

The wall 13 is also formed with three vertical slots 35 for engagement with coat hangers even when the arms 15 and 16 are collapsed.

Figure 3:
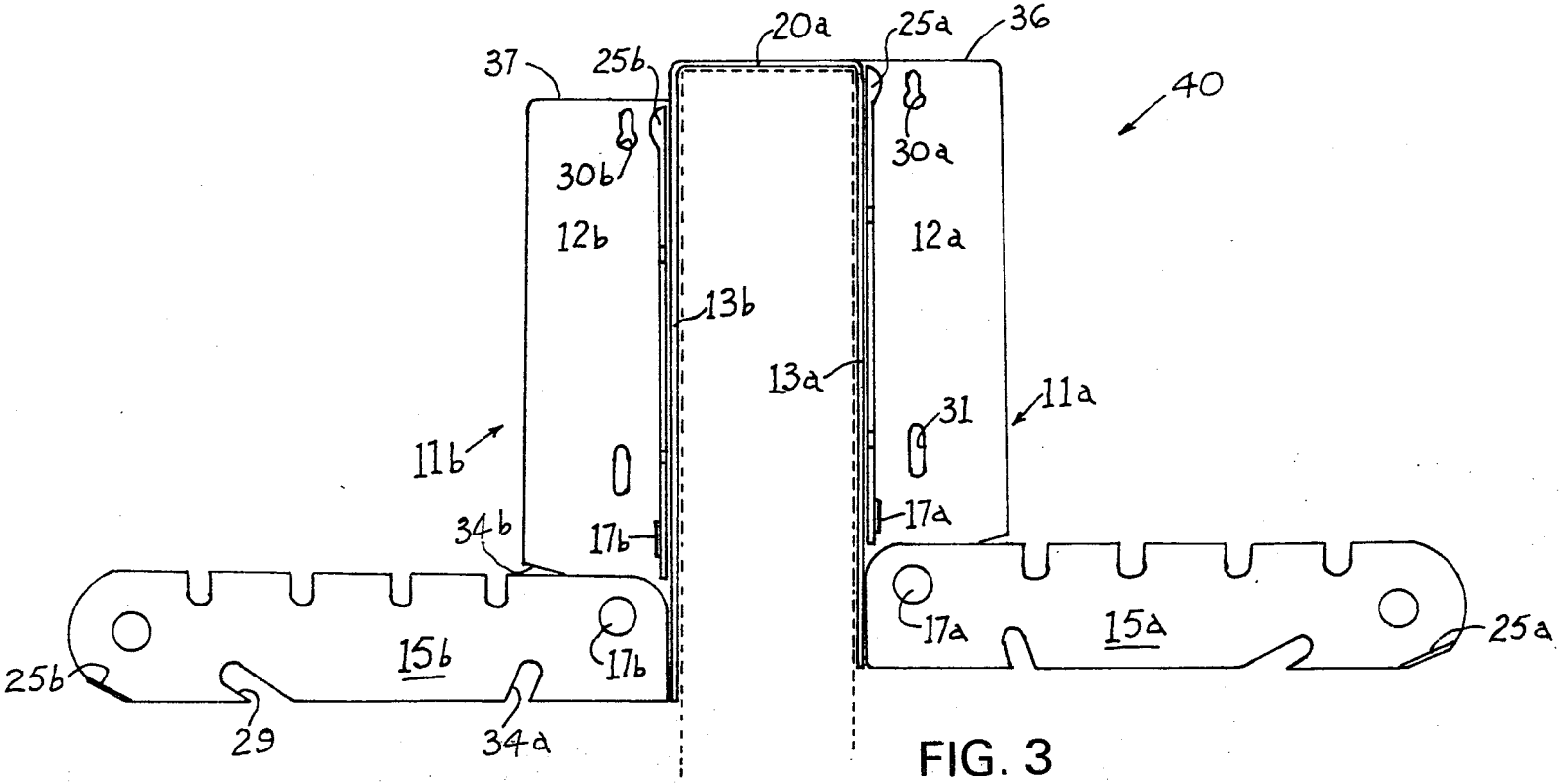
FIG. 3 shows a view taken in side elevation of a collapsible hanger device according to a second embodiment of the present invention.

FIG. 3 shows a modification of the hanger device, indicated generally by reference numeral 40, in which parts corresponding to those already described with reference to FIGS. 1 and 2 are indicated by the same reference numerals followed by the suffix "a" or "b".

The hanger device 40 is, as can be seen, a double hanger device having two elongate members **11*a* and 11*b* connected by a bridge portion 20*a* and provided with pivotal arms 15*a*, 16*a* and 15*b*, 16*b*, respectively, which are pivotally secured by rivets 17*a* and 17*b*. As will be readily apparent, the holder device 40 can be fitted over the top of a door with the elongate members 11*a* and 11*b*** at opposite sides of the door, so as to provide, at each side of the door, a pair of pivotal arms.

While the wall **12*a* has an uppermost edge 36 flush with the bridge portion 20*a*, the wall 12*b* has an uppermost edge 37 which is downwardly offset by approximately ⅜ inch from the bridge portion 20*a*** to provide a clearance between the hanger and the door jamb when the door is closed.

Figure 4:
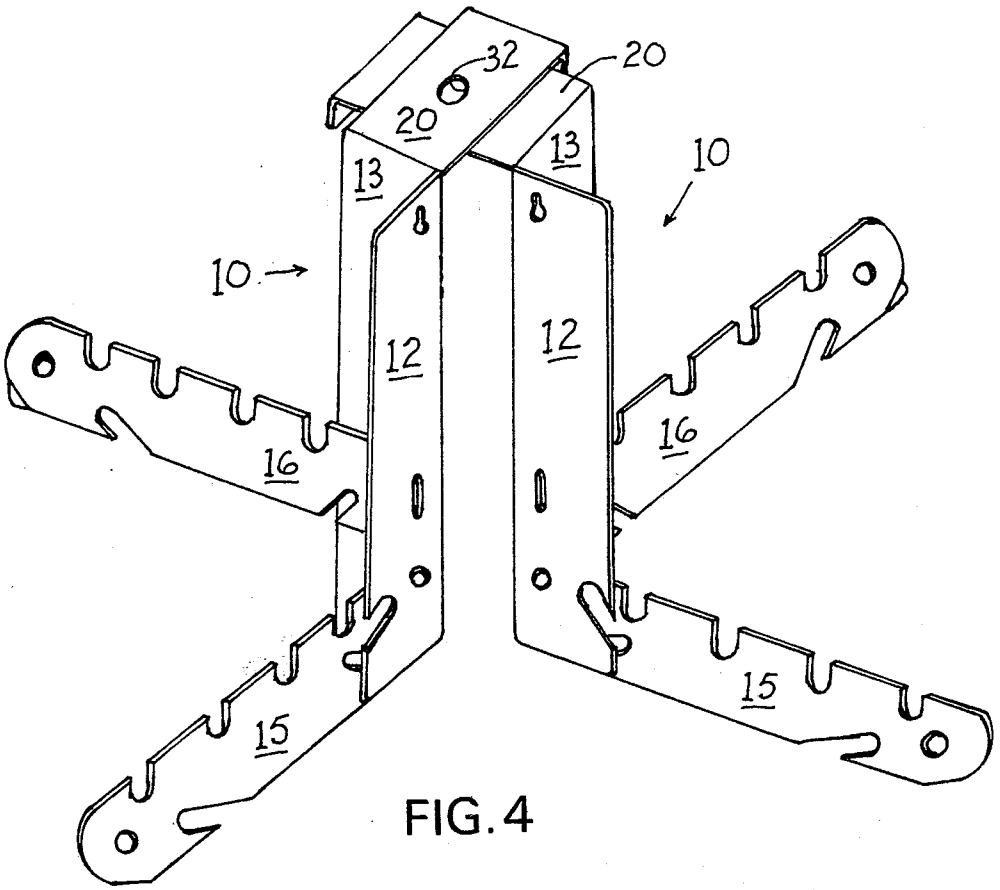
FIG. 4 shows a view in perspective of a pair of hanger devices according to FIG. 1.

FIG. 4 shows a pair of the holder devices 10, as described hereinabove with reference to FIGS. 1 and 2, arranged with their strip-shaped members 20 superimposed one on the other, with the openings 32 aligned, and with the two walls 13 extending in planes at right angles to one another. Such an arrangement provides arms 15 and 16 which, when in their extended positions as shown in FIG. 4, extend outwardly in four different, mutually perpendicular directions. Such an arrangement can be used, for example, when the two holder devices 10 are mounted on the top of a post or the like of square cross-section.

Figure 5:
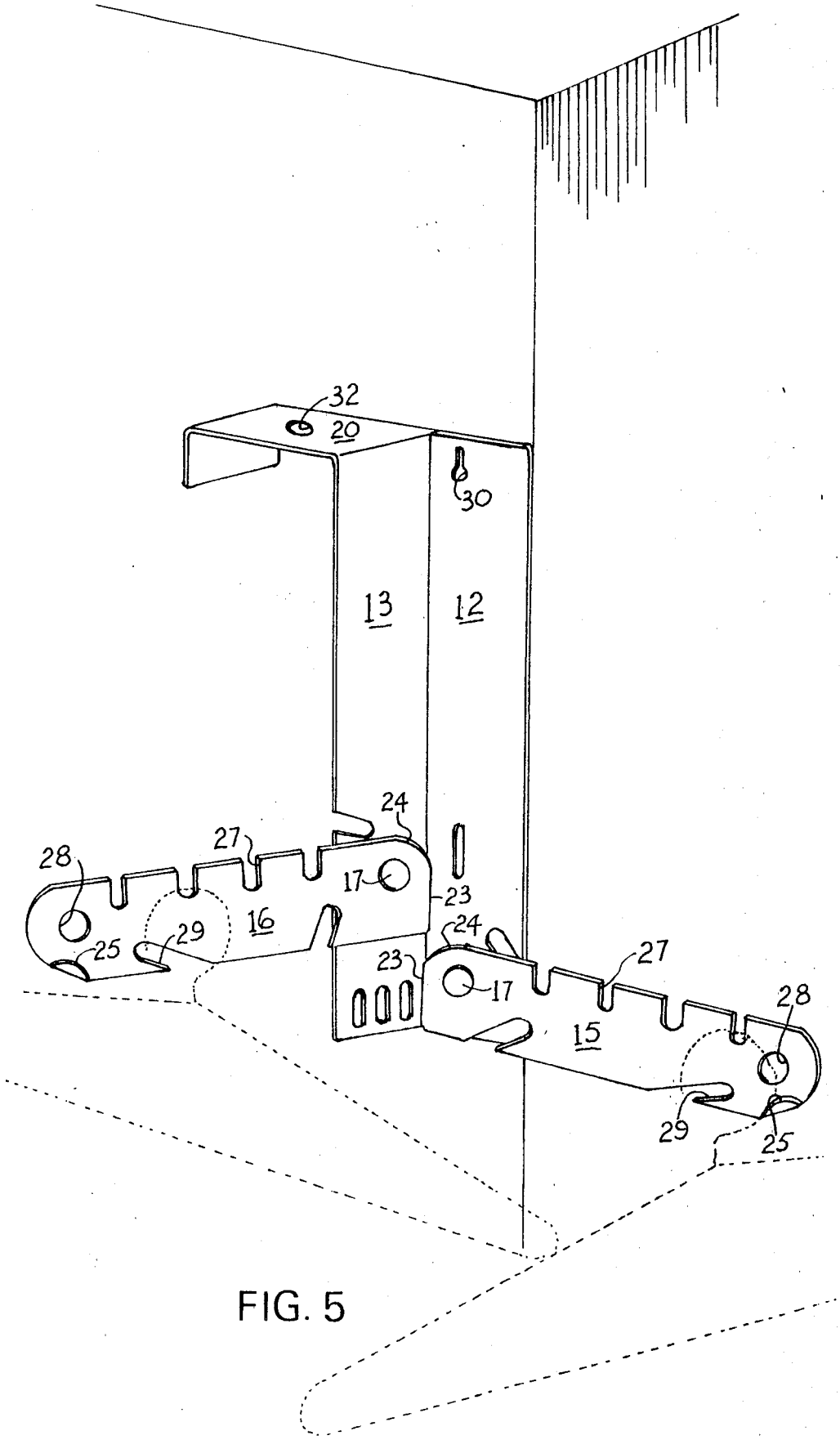
FIG. 5 shows a view in perspective of the device of FIG. 1 affixed to an outer corner of a wall and in an extended condition.

As will be apparent from FIG. 5, the hangers 10 shown therein are similar except that the wall 12 of one is located at the opposite edge of the wall 13 compared to the wall 12 of the other.

FIG. 5 shows the hanger 10 of FIG. 1 positioned at an outside corner, prior to insertion of mounting screws (not shown) into the holes 30 and 31, with the arms 15 and 16 extended, and illustrates how the arms project from the corner for use, for example, in supporting clothes hangers, which are shown in broken lines and, for convenience of illustration, have been greatly reduced in size.

The embodiments of the invention in which an exclusive property or privilege is claimed are defined as follows:

1. A collapsible hanger device comprising:

an elongate member having a pair of mutually angularly disposed walls extending longitudinally thereof;

a pair of arms pivotally mounted on respective ones of said walls;

said arms being pivotal relative to said walls about respective mutually angled axes of pivotation between collapsed positions, in which said arms are nestled in an angular space defined by said walls with said arms extending longitudinally of said elongate member, and extended positions, in which said arms project laterally of said elongate member;

means for releasably supporting said arms in said extended positions; and means for suspending said elongate member from a support.

2. A collapsible hanger device as claimed in claim 1, wherein said suspension means comprise hook means extending from one of said walls for engagement over the top of a door.

3. A collapsible hanger device as claimed in claim 2, wherein said suspension means further comprise means defining a hole in the other of said walls for engagement with a support screw.

4. A collapsible hanger device as claimed in claim 2 or 3, wherein said hook means comprise a strip-shaped member extending from and perpendicular to said one wall, and wherein an opening is provided in said strip-shaped member for receiving a securement screw, whereby said device can be utilized as a handgrip for an article when secured to said article by said screw.

5. A collapsible hanger device as claimed in claim 1, 2 or 3, wherein said elongate member is a channel-shaped member, said walls being formed by flanges of said channel-shaped member.

6. A collapsible hanger device as claimed in claim 1, 2 or 3, wherein said arms comprise strip-shaped members disposed in planes parallel to the planes of respective ones of said walls, said strip-shaped members being formed with lug means projecting therefrom to facilitate manual engagement of said strip-shaped members in the collapsed positions.

7. A collapsible hanger device as claimed in claim 1, 2 or 3, wherein said supporting means comprise abutments formed on said arms for engagement with said walls on pivotation of said arms with the extended positions.

8. A collapsible hanger device as claimed in claim 1, 2 or 3, wherein each of said arms is formed with an opening remote from the respective said axis of pivotation to facilitate securement of cords to said arms.

9. A collapsible hanger device as claimed in claim 1, 2 or 3, wherein each of said arms is formed with an elongate recess extending at an inclination from a lowermost edge of the respective said arm, when the latter is in its extended position, to facilitate securement of cords to said arms.

10. A collapsible hanger device as claimed in claim 1, 2 or 3, further comprising means defining an elongate recess in one of said walls and extending at an inclination to a longitudinal edge of said one wall and means defining a corresponding elongate recess in an edge of one of said arms, said recesses being aligned, when said arm is in its collapsed positions, to form a bottle opener.

11. A collapsible hanger device as claimed in claim 1, 2 or 3, further comprising means defining an opening in one of said walls for engagement with a coat hanger when said arms are in their collapsed positions.

* * * * *